United States Patent [19]

Czelusniak, Jr.

[11] 4,398,479

[45] Aug. 16, 1983

[54] TUFTING MACHINE WITH SHIFTABLE AND INDEXING NEEDLE BARS AND METHOD OF TUFTING

[75] Inventor: Paul A. Czelusniak, Jr., Eden, N.C.

[73] Assignee: Fieldcrest Mills, Inc., Eden, N.C.

[21] Appl. No.: 277,965

[22] Filed: Jun. 26, 1981

[51] Int. Cl.[3] ..... D05C 15/00

[52] U.S. Cl. ..... 112/79 R; 66/207; 112/79 A; 112/266.2

[58] Field of Search ..... 112/79 R, 79 A, 163, 112/167, 266.2; 66/205, 214, 207

[56] References Cited

U.S. PATENT DOCUMENTS

| | | | |
|---|---|---|---|
| 3,633,523 | 1/1972 | Card | 112/79 A |
| 4,051,698 | 10/1977 | Leonhardt | 66/205 |
| 4,119,049 | 10/1978 | Puckett | 112/266.2 |

FOREIGN PATENT DOCUMENTS

| | | | |
|---|---|---|---|
| 631443 | 11/1961 | Canada | 112/79 A |
| 1438173 | 6/1976 | United Kingdom | 112/79 A |

*Primary Examiner*—Ronald Feldbaum

*Attorney, Agent, or Firm*—Bell, Seltzer, Park & Gibson

[57] ABSTRACT

The tufting machine has a pair of elongate needle bars with respective rows of tufting needles thereon extending transversely of the machine and normally forming a single row of aligned needles for serving as one needle bar during each turfting operation, with the needles in one row arranged in alternation with the needles in the other row. The needle bars and needles are so constructed and arranged that the needles in one row are shiftable laterally out of and laterally back into alignment with the needles in the other row. While the needles in one row are out of alignment with the needles in the other row, either or both rows of needles are shiftable longitudinally for changing the order of the needles when the needles are again shifted back into alignment with each other.

13 Claims, 13 Drawing Figures

TUFTING MACHINE WITH SHIFTABLE AND INDEXING NEEDLE BARS AND METHOD OF TUFTING

This invention relates to tufting machines and more particularly to multi-needle bar tufting machines for the forming of pile tufted fabrics of a wide variety of patterns. It is well known that in multi-needle bar tufting machines the needle bars of the customary pair are spaced apart from each other one quarter of an inch with needles on one bar being offset or staggered relative to the needles on the other bar. While the prior art teaches the needles of the respective bars being shoggable relative to each other for forming a wide variety of pattern effects, the needle bars always remain in spaced relation to each other when penetrating a base fabric in the forming of pile tufts thereon.

In the instant invention, the pair of needle bars are constructed and arranged relative to each other so that the rows of needles on the bars may be indexingly arranged with each other so that the needles are in transverse alignment during each active stroke of the needles in penetrating the base fabric and in the forming of pile tufts thereon. Upon the thus transversely aligned needles being retracted from the base fabric, means are provided for moving the needles out of transverse alignment so that the needle bars may then be shogged relative to each other for effecting the desired pattern arrangement of the next transverse row of pile tufts.

This feature of the invention, wherein the rows of needles on the respective needle bars are moved into transverse alignment with each other for forming each transverse row of pile tufts, presents a number of desirable advantages over the prior art. Of considerable importance is the fact that fabrics formed in accordance with this invention may be of any given number of rows of pile tufts per inch of fabric, as measured in the machine direction, merely by changing the rate of advancement of the base fabric past the needle tufting station. The slowing down of the movement of the base fabric will result in an increased overall pile density of fabric, whereas the speeding up or faster movement of the base fabric past the pile tufting staton will decrease the overall pile density of fabric. This ease of changing the overall pile density is of considerable importance in facilitating the obtaining of the desired fabric constructions with a precise pile density of fabric.

Those well versed in prior art multi-needle bar tufting machines will readily understand that the rate of the base fabric being advanced through the tufting machine could only be adjustably varied so as to accord with a whole number of transverse rows of pile tufts between the respective pair of needle bars, otherwise, the pile tufts of one needle bar would not be in transverse alignment with the pile tufts of the other needle bar, but instead, would present a distorted appearance to the fabric.

A further desirable feature of this invention is that less waste of pile yarn is occasioned at the beginning and trailing ends of a run of fabric due to the fact that both needle bars penetrate the base fabric in an aligned transverse row instead of being spaced apart in the machine direction as in all prior art multi-needle bar machines.

With the foregoing in mind, it is an object of this invention to provide a method and apparatus for producing tufted fabrics in which the patterning advantages afforded by utilizing two needle bars may be fully realized, without the disadvantage of the problem presented by two needle bars when relatively small changes in pile weight per unit length are desired in tufted fabrics.

More particularly, it is an object of this invention to provide a method and apparatus for forming a tufted pile fabric on a tufting machine utilizing a pair of needle bars which are so positioned during each tufting operation that rows of needles on the respective bars are aligned with each other transversely of the machine with the needles of one bar arranged in alternation with the needles of the other bar, but wherein, between successive tufting operations, the relative order of the yarns carried by the respective needles is changed by moving one or the other, or both, rows of needles so they are out of alignment with each other, longitudinally shifting either or both rows of needles relatively, and then moving the rows back into alignment with each other preparatory to a succeeding tufting operation of the needles.

A further object of this invention is to provide a method and apparatus for forming a tufted pile fabric to obtain the precise overall pile density of fabric utilizing a pair of relatively movable needle bars with respective rows of tufting needles thereon as set forth above, and wherein the rate at which the fabric is advanced past the needle bars is adjusted so that the rows of pile tufts formed widthwise of the fabric by the needles may be readily changed in number per unit length of fabric to obtain the precise desired pile density of fabric. It can be appreciated that, since all the needles in the two rows are in alignment with each other widthwise of the base fabric during each passing of the needles through the base fabric during each tufting operation, each widthwise row of pile tufts formed by the needles will be straight regardless of whether the rate of advancement of the base fabric past the tufting needles is such as to obtain a whole number of rows of tufts or a mixed number of rows of tufts per inch of fabric.

BRIEF DESCRIPTION OF THE DRAWINGS

Some of the objects and advantages of the invention having been stated, others will appear when taken in connection with the accompanying drawings, in which.

DETAILED DESCRIPTION

While this invention will be described hereinafter with particular reference to the accompanying drawings, in which an illustrative embodiment of the present invention is set forth, it is to be understood at the outset of the description which follows that it is contemplated that persons skilled in the applicable arts may modify the specific details to be described while continuing to use this invention. Accordingly, the description is to be understood as a broad teaching of this invention, directed to persons skilled in the applicable arts.

Figure 1:
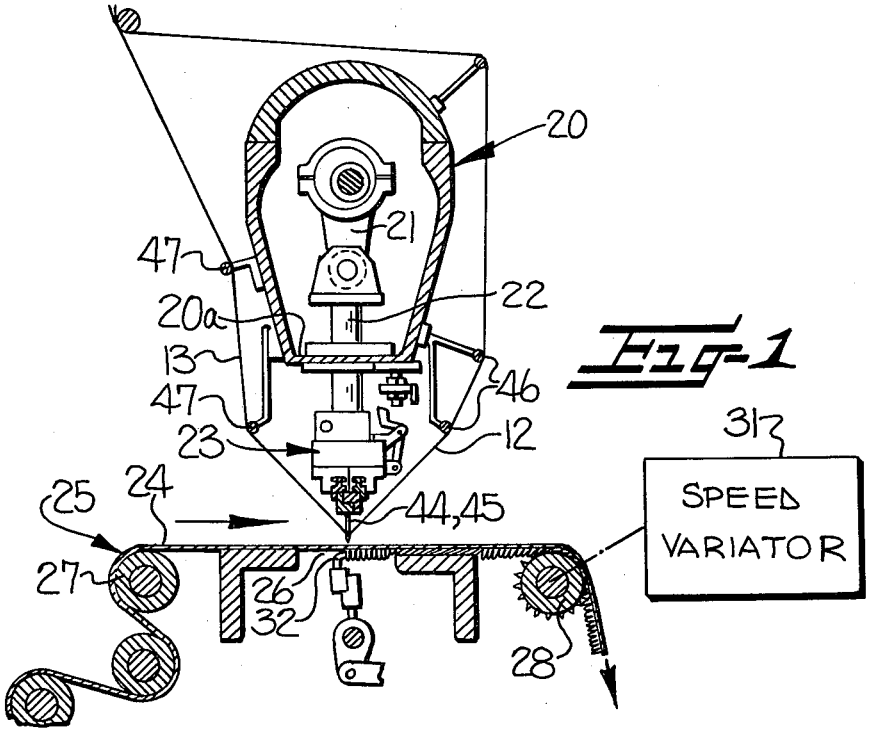
FIG. 1 is a longitudinal vertical sectional view through a tufting machine embodying the present invention.
Figure 2:
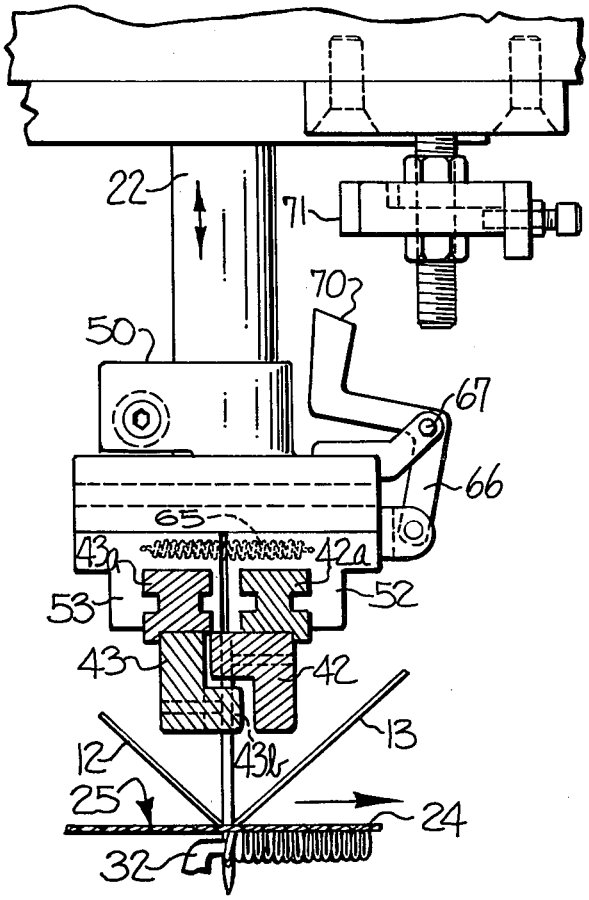
FIG. 2 is an enlarged fragmentary view of the tufting station shown in the central portion of FIG. 1 and showing the two sets or rows of needles in indexing relation to each other and in tuft-forming position penetrating the base fabric.
Figure 3:
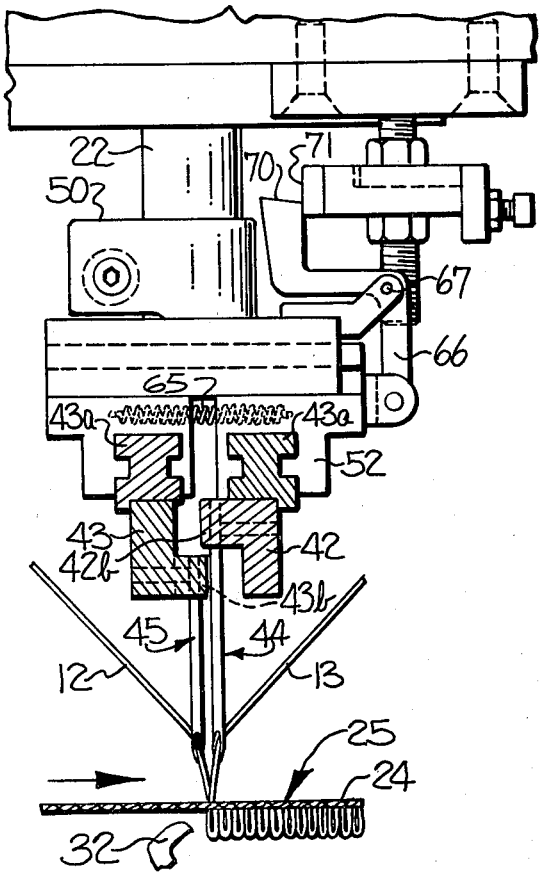
FIG. 3 is a view similar to FIG. 2, but showing the two sets of needles out of alignment with each other and in raised position withdrawn from the base fabric.
Figure 8:
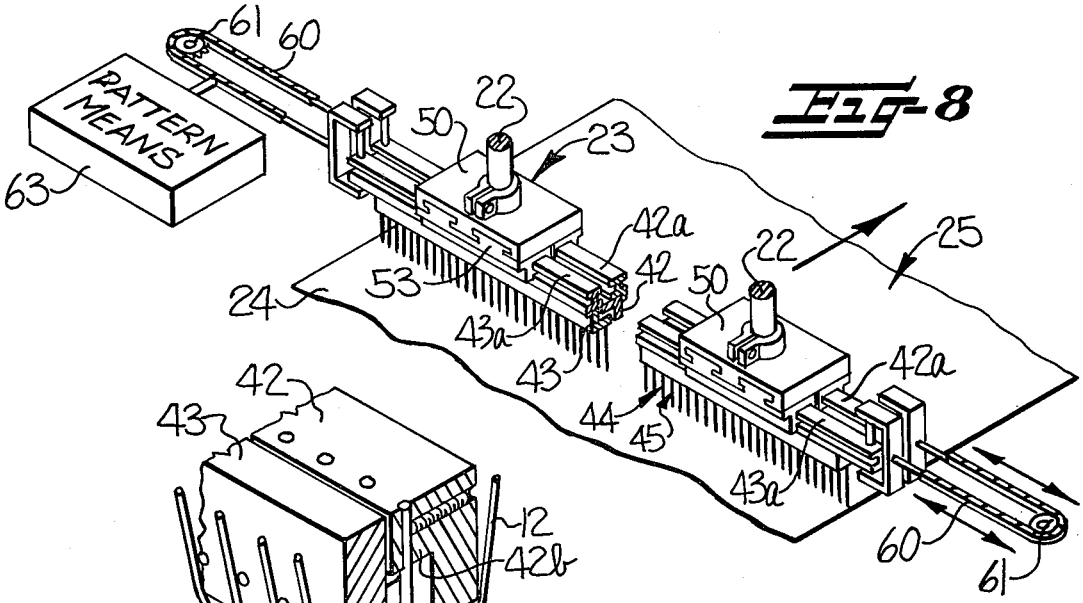
FIG. 8 is a perspective view of the needle bars and the respective rows of tufting needles showing how they may be mounted for relative lateral movement and for pattern controlled longitudinal relative shifting movement transversely of the base fabric.

The apparatus and method of the present invention may be applied to otherwise conventional tufting machines. Therefore, only a general description of the tufting machine will be given with particular reference to FIG. 1 wherein it will be observed that the tufting machine there shown comprises a frame or housing 20 having driving mechanism 21 therein for imparting active and inactive, downward and upward strokes to a plurality of substantially vertically disposed reciprocatory shafts 22, only one of which is shown in FIGS. 1, 2 and 3. The shafts 22 are arranged in a transverse row across the machine (see FIG. 8), slideably penetrate the bottom wall or plate 20*a* of housing or frame 20, and have respective supporting means thereon, broadly designated at 23, for supporting the needle bars of the present invention in a manner to be later described.

A backing or base 24 of a tufted pile fabric 25 being formed is moved forwardly across the throat 26 of the tufting machine from a guide roll 27 (FIG. 1) to a take-up roll 28 whose speed may be controlled by a suitable variable speed mechanism or speed variator indicated schematically at 31. A series of loopers 32 oscillates beneath the throat 26 to engage and form loop pile tufts from the pile yarns carried by the needles, as is conventional. If cut pile is to be produced, it is apparent that suitable cutting blades may be operably associated with the loopers 32, which would then be reversely positioned to face in the opposite direction, as is well known in the art, for cutting the loops following the formation thereof over the loopers. The parts of the tufting machine heretofore described, and the operation thereof, are well known to those familiar with the art and a further description thereof is thus deemed unnecessary. The needle bar arrangements of the present invention are adapted for use with such a conventional tufting machine and will now be described in detail.

Referring now to FIGS. 1–10, in the first embodiment of the apparatus of this invention, the numerals 42, 43 designate a pair of first and second elongate needle bars which carry respective first and second rows or sets of tufting needles 44, 45 and extend transversely or widthwise of the path of travel of the base fabric 24 therebeneath. The needles 44, 45 have respective first and second sets of pile yarns extending downwardly therethrough for forming therefrom respective pile tufts 12*a*, 13*a* (FIGS. 4–7) arranged in longitudinally extending rows and transversely or widthwise extending rows on the face of the base fabric 24. As is usual, in its passage through the tufting machine, the face of the tufted fabric 25 faces downwardly as shown in FIGS. 1–7. Preferably, the tufting machine is provided with guide means, including guide rods 46, 47 (FIG. 1), for directing the pile yarns 12, 13 to the respective rows of needles 44, 45 in a downwardly convergent manner so that the pile yarns 12 being directed to the first row of needles 44 extend downwardly and inwardly in converging relation to the pile yarns 13 being directed to the second row of needles 45 to avoid entangling the pile yarns with the needles during shifting of either row of needles longitudinally relative to the other row of needles, in a manner to be presently described.

The needle bars 42, 43 with the needles 44, 45 thereon, are so supported by the supporting means 23, and are so constructed and arranged that the needles 44 in the first row are shiftable laterally out of and laterally back into indexing relationship or alignment with the needles 45 in the second row to form therefrom a single row of aligned needles, as shown in FIGS. 2, 4, 7, and 9, for serving as one needle bar during the tufting operations. Accordingly, each supporting means 23 comprises an upper guide bracket 50 suitably secured to the lower end portion of each upright shaft 22 and having a pair of guide blocks 52, 53 depending from respective front and rear portions thereof. In this instance, the guide block 53 is stationary or fixed with respect to the respective bracket 50, and the guide block 52 is guided for forward and rearward lateral movement relative to each respective bracket 50.

The needle bars 42, 43 are suitably attached to, or may be formed integrally with, respectively elongate guide bars 42*a*, 43*a* thereabove (FIGS. 2 and 3), which are, in turn, guided in the respective guide blocks 52, 53 (FIGS. 2 and 3) for longitudinal movement transversely of the machine. Thus, it can be seen that the brackets 50 serve to mount both needle bars 42, 43 for longitudinal movement transversely of the machine while also serving to mount the front or first needle bar for lateral shifting movement forwardly and rearwardly relative to the second needle bar 43. Although only the front needle bar 42 has been described as being movable laterally of the rear needle bar 43, it is apparent that the rear needle bar 43 may be movable forwardly and rearwardly, laterally of the front needle bar 42 in addition to, or instead of, the front needle bar 42 being movable forwardly and rearwardly, without departing from the invention.

In order to support the rows of needles 44, 45 on the respective needle bars 42, 43 while permitting movement of the two rows of needles 44, 45 into and out of alignment, and utilizing needles which are substantially straight throughout their respective lengths, as in the first embodiment of the invention, the needles 44 in one row are of substantially uniform length but are longer than the needles 45 in the other row, and the upper portions of the longer needles 44 extend into and are secured to a portion 42*b* extending longitudinally of the first needle bar 42. The latter portion 42*b* of the needle bar 42 projects rearwardly and normally overlies a longitudinally extending row of spaced-apart forwardly projecting, boss portions 43*b* on the lower portion of the other or second needle bar 43 (see FIG. 10) whenever the needles 44 in the first row are positioned in alignment with the needles 45 in the second row for forming the aforementioned single row of aligned needles, as shown in FIG. 2.

Thus, the upper portions of the shorter needles 45 are suitably secured in the forwardly projecting boss portions 43*b* on the lower portion of the second needle bar 43, there being one of the boss portions 43*b* for each of the needles 45 in the second row. It can be appreciated that, even though the needles 45 are somewhat shorter than the needles 44, the pointed free ends of the needles 44, 45 preferably terminate on a common plane such that all the needles will penetrate the base fabric 24 to substantially the same extent during each loop-forming operation.

Whenever the needles 44, 45 in both rows are in alignment transversely of the machine, it is apparent that the needles 44 in the first row are then arranged in alternation with the needles 45 in the second row. Accordingly, it follows that the forwardly projecting boss portions 43*b* on the lower portion of the second needle bar 43 are spaced apart from each other sufficiently to permit the needles 44 to readily move into and out of the spaces between the boss portions 43*b* whenever the needles 44 in the first row are being shifted into and out of alignment with the needles 45 in the second row.

Any suitable means may be provided for shifting one or the other or both of the needle bars 42, 43 longitudinally (transversely of the path of travel of the base fabric 24 through the machine) while the needles 44, 45 are in the raised or withdrawn position relative to the fabric 25 for changing the order of the needles in the single row to be formed when the needles 44 are shifted back into alignment with the needles 45, and in accordance with a pedetermined pattern. Accordingly, it will be observed in FIG. 8 that opposite ends of the needle bars 42, 43 are connected, via the respective guide bars 42*a*, 43*a*, to opposite ends of a pair of pliable elements shown in the form of sprocket chains 60, there being one of the sprocket chains 60 provided at each side of the machine entrained about a respective sprocket wheel 61. Either or both sprocket chains 60 may be moved a predetermined distance by a suitable pattern means or device 63 which operates in such timed relation to the vertical reciprocatory motion of the shafts 22 (FIGS. 1, 2, and 3) as to shift the needles 44 in the first row in one longitudinal direction transversely of the path of travel of the base fabric 24 for a predetermined distance while shifting the needles 45 of the other or second row a like distance but in the opposite direction from that in which the needles 44 are being shifted and while the needles 44 in the first row are out of alignment with the needles 45 in the second row, as shown in FIG. 3.

Any suitable means may be provided for shifting the first row of needles laterally out of and laterally back into alignment with the needles in the second row. In this instance, it will be observed in FIGS. 2 and 3 that means is provided, which is operable in response to each upward stroke of the tufting needles 44, 45 for shifting the needles 44 of one row out of alignment with the needles 45 of the other row. To this end, the movable guide block 52 of each supporting means 23, one of which is shown in FIGS. 2 and 3, is normally biased rearwardly toward the respective guide block 53, as by means of a tension spring 65, and the outer portion of each movable guide block 52 is pivotally connected to one arm of a bellcrank 66 which is pivotally connected at its elbow portion, as at 67, to the respective bracket 50.

A cam 70 on the bellcrank 66 is positioned so as to engage a vertically and horizontally adjustable abutment 71 in the course of each upward stroke of the needle bars 42, 43. The relative positions of the cam 70 and abutment 71 are such that the abutment 71 will cause the bellcrank 66 to move in a counterclockwise direction from the position of FIG. 2 to that of FIG. 3, thus moving each movable guide block 52 forwardly relative to the respective bracket 50 and in opposition to the spring means 65. The extent of such forward movement of guide block 52 is such as to move the needles 44 on the first needle bar 42 out of alignment with the projections 43*b* on the needle bar 43 to permit the pattern means 63 (FIG. 8) to move the needle bars 42, 43 longitudinally in opposite directions relative to each other for a distance preferably at least equal to one gauge, i.e, the center-to-center distance between adjacent longitudinal row of tufts, or a multiple thereof. Whenever the needles 44 of the first row are indexingly arranged and aligned with the needles 45 of the second row, as in FIGS. 2, 4, 7, and 9, it is apparent that the centers of adjacent needles 44, 45 are then spaced one gauge apart. By the same token, it follows that the center-to-center distance between adjacent needles in each respective row 44, 45 is equal to two gauges.

Since the needle bars 42, 43 are, in effect, interconnected by the sprocket chains 60, it should be noted that each time that the pattern means 63 calls for a longitudinal shift of the needle bars 42, 43, the needles in each respective row are moved one gauge transversely of the path of travel of the base fabric 24 (FIGS. 1–8), but the needles 44 are moved in the opposite direction from that of the needles 45. In producing the fabric 25 with a pattern such as is represented in FIGS. 4–7, it can be appreciated that the first needle bar 42 would be moved in one direction transversely of the fabric on alternate movements of the needle bar 42, e.g., left to right in FIGS. 5 and 6, and the first needle bar 42 would be moved in the opposite direction, e.g., right to left in FIGS. 5 and 6, on intervening movements of the needle bar 42.

Figure 4:
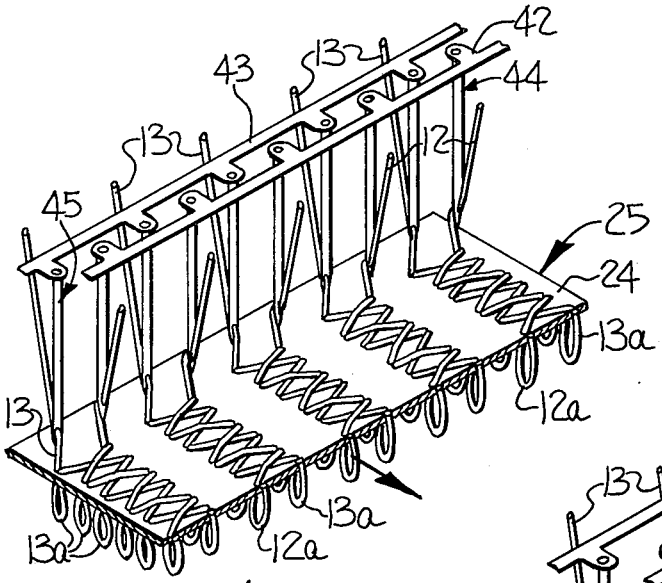
FIGS. 4–7 are fragmentary perspective views illustrating successive stages in the operation of the two needle bars and the respective two sets of needles in accordance with the present invention.

According to the method of this invention, in the operation of the tufting machine, it is apparent that the two rows of needles 44, 45 normally are indexingly arranged in alignment with each other to form a composite or single transverse row of tufting needles with the needles 44 of the first row being positioned in alternation with the needles 45 of the second row, as shown in FIGS. 2 and 4, during each movement of the needles 44, 45 into the base fabric 24 incidental to each successive tuft-forming operation of the needles. As is usual, the base fabric 24 is advanced or moved forwardly by the takeup roll 28 a predetermined amount past the tufting station during each tuft-forming operation of the tufting machine. In order to cross the pile yarns of one set relative to the pile yarns of the other set on the reverse or back side (FIGS. 4–7) of the base fabric 24 opposite from the pile tufts, following each tuft-forming operation of the needles, they move upwardly from the base fabric 24 and then one of the needle bars (the needle bar 44 in this instance) moves laterally of the other needle bar to move the respective row of needles laterally or in the machine direction out of alignment with the other row of needles.

Figure 5:
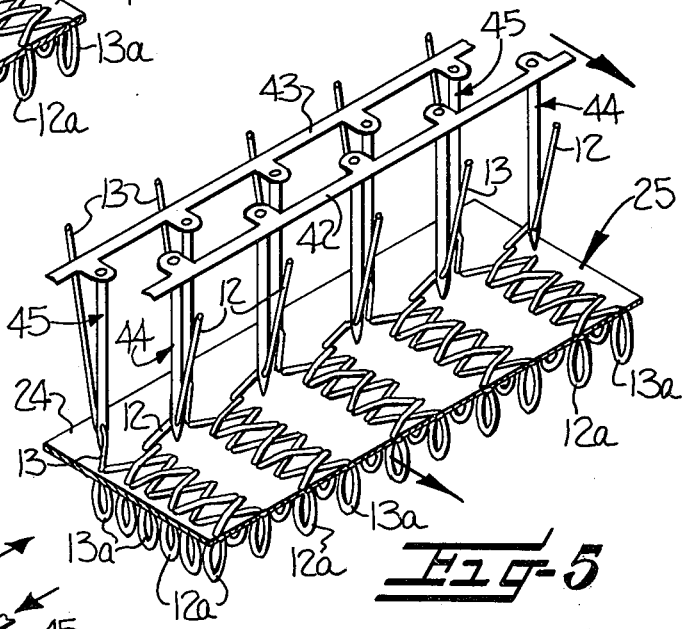
Figure 6:
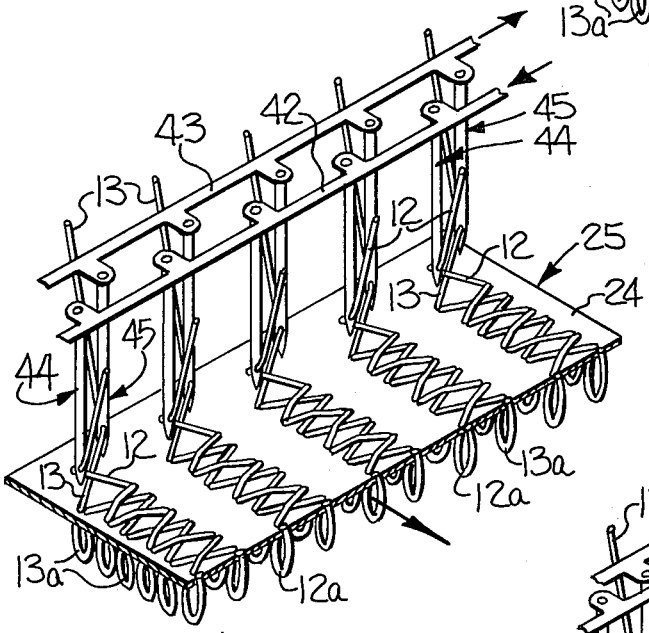

Thus, it will be seen in FIG. 5 that the row of needles 44 has moved forwardly from the position of FIG. 4 and out of alignment with the row of needles 45. Thereupon, the needle bars 42, 43 and their respective rows of needles 44, 45 are moved longitudinally relative to each other, i.e., transversely of the base fabric 24. In this instance, the needle bar 42 and needles 44 have moved from right to left and the needle bar 43 and needles 45 have moved from left to right, from the position of FIG. 5 to the position of FIG. 6, so that the relative positions of the needles in the two rows 44, 45 have changed, in this instance, by a distance equivalent to one gauge, thus crossing the pile yarns 12 from right to left in FIGS. 5 and 6 relative to the pile yarns 13 which are being crossed simultaneously from left to right in FIGS. 5 and 6.

Figure 7:
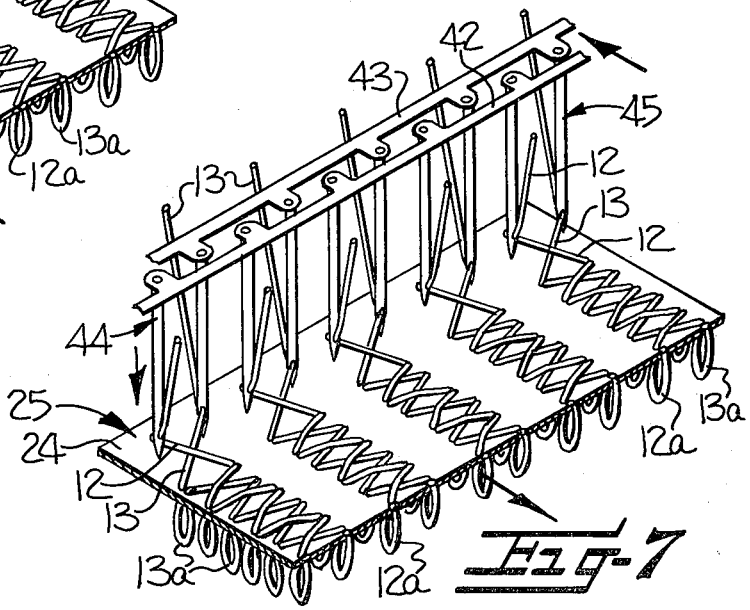

Thereafter, an active stroke of the needles occurs, during the course of which cam 70 moves out of engagement with abutment 71 (FIGS. 2 and 3), permitting the needle bar 42 and its needles 44 to move rearwardly and thereby move the needles 44 into alignment with the needles 45 so that, in effect, the two rows of needles 44, 45 then function as a single row of needles as in FIGS. 2 and 7.

The speed variator 31 is shown in FIG. 1 to point up the fact that even though the pile yarns 12, 13 cross each other on the reverse side of the base fabric from the tufts being formed, by positioning the two sets of tufting needles 44, 45 so that they are aligned with each other to form a composite or single transverse row of tufting needles thereof by the time the needles penetrate the base fabric 24 in the forming of each transverse row of tufts in the fabric 25, such arrangement of the needles readily permits varying the speed of the base fabric advancing means (take-up roll 28) to adjust or vary the number of widthwise rows of pile tufts per inch longitudinally of the fabric without distorting the fabric design or pattern, to enable tufted fabrics to be made with a mixed number (a number composed of an integer and a fraction) of rows of pile tufts per inch of fabric, as is desirable to obltain the precise desired overall pile density of fabric. It has been determined that fabrics formed by a pair of needle bars indexable with each other so as to function as a single row of needles would, in most all instances, have a mixed number of transverse rows of pile tufts per inch of fabric.

Figure 9:
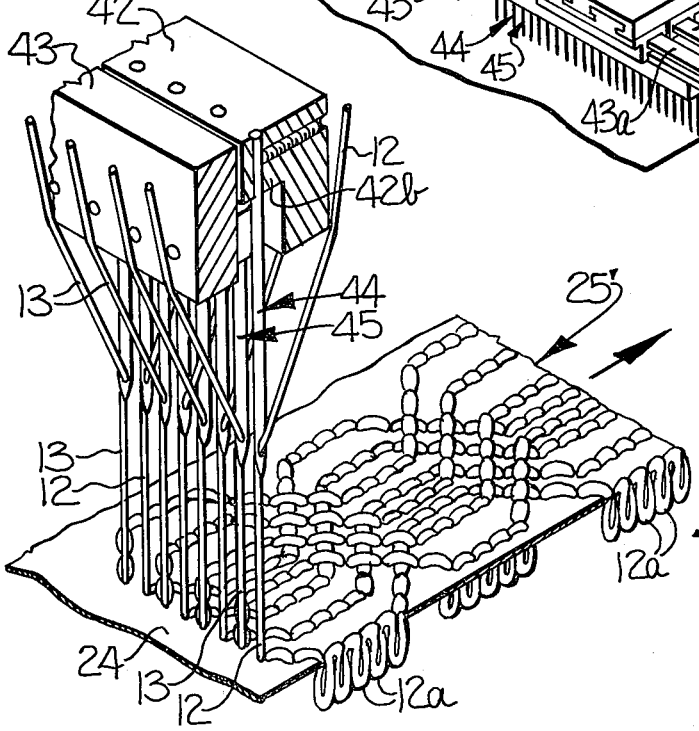
FIG. 9 is an enlarged fragmentary perspective view of portions of the tufting station in association with a portion of tufted pile fabric having a different tuft pattern arrangement than the pile fabric portions of FIGS. 4–7, to illustrate that the invention permits the production of a wise variety of pile fabrics.
Figure 10:
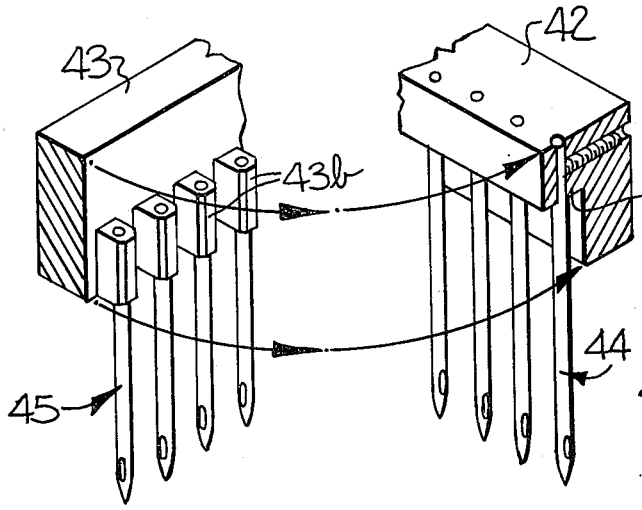
FIG. 10 is a fragmentary, partially exploded, perspective view of the two needle bars shown in FIGS. 1–9.

Although the needle bar 42 has been described above as being moved in one direction on alternate longitudinal movements thereof, but being moved in the opposite direction on intervening longitudinal movements thereof, in producing a fabric such as that indicated at 25' in FIG. 9 it can be appreciated that the pattern device 63 causes the first needle bar 42 to move transversely of the base fabric in the same direction, in a stepwise manner, during a plurality of immediately successive tuft-forming cycles of the tufting machine, with the second needle bar 43 moving transversely of the base fabric in the opposite direction from the first needle bar 42 during the latter plurality of tuft-forming cycles of the tufting machine.

For example, by observing the arrangment of the portions of the pile yarns 12, 13 forming the bights or bases of the pile tufts in FIG. 9, it can be seen that the needles 44 in the first row are progressively stepped outwardly in one transverse direction during four successive tuft-forming cycles, whereupon the needles 44 dwell during four succeeding tuft-forming cycles, and after which the needles are progressively stepped inwardly in the opposite transverse direction from that in which they had previously stepped outwardly, to complete the pattern cycle. Of course, concurrently with the tuft-forming cycles of the first row of needles 44 as last described, the second row of needles 45 are also progressively stepped inwardly in said other transverse direction during four successive tuft-forming cycles, then the needles 45 dwell for four such cycles, after which the needles 45 are progressively stepped outwardly for four tuft-forming cycles to complete the pattern cycle thereof. Thus, it can be seen that a wide variety of different pattern designs of tufts may be formed utilizing the needle bars and needles of the present invention.

Modified Form of Needle Bars

Figure 11:
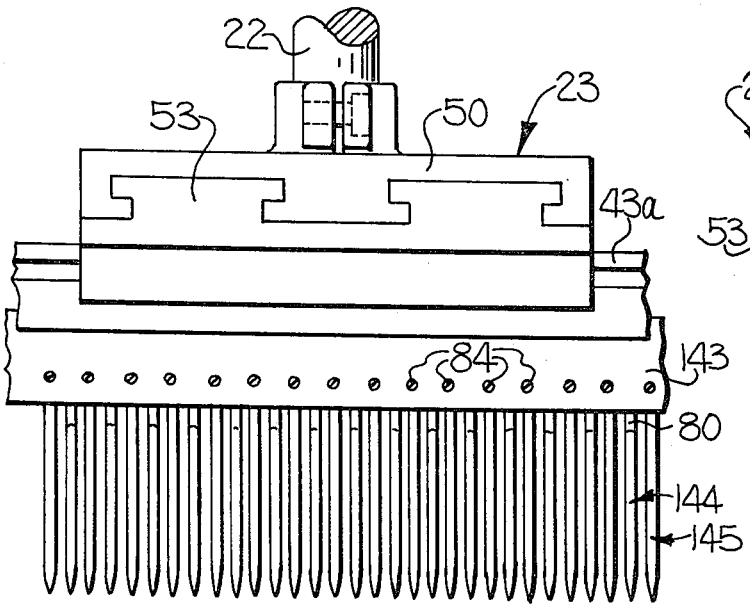
FIG. 11 is a fragmentary view of one side of support means for the needle bars, but showing a second or modified embodiment of the needle bars and associated tufting needles carried by the support means.
Figure 12:
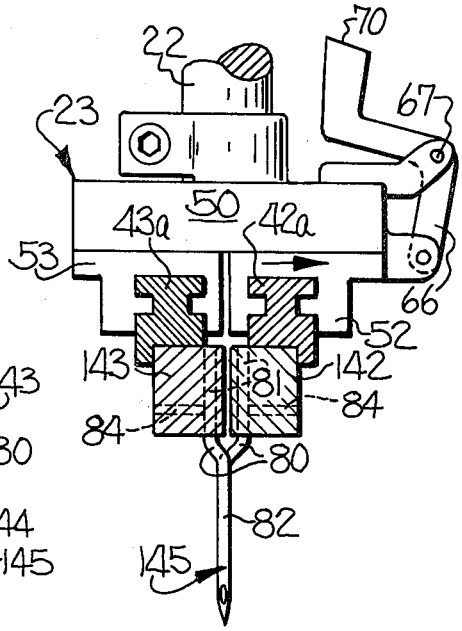
FIG. 12 is a view, partially in section, looking at the right-hand side of FIG. 11.
Figure 13:
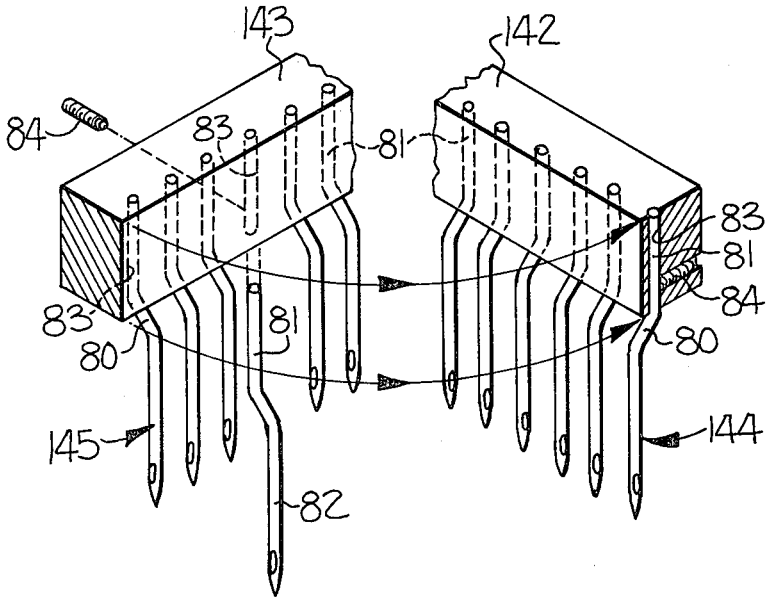
FIG. 13 is a partially exploded perspective view similar to FIG. 10, but illustrating the second embodiment of needle bars and tufting needles.

Referring now to FIGS. 11–13, there will be observed a needle bar arrangement which is generally similar to that heretofore described with respect to the first embodiment of the invention in FIGS. 1–10. Accordingly, with the exception of the needle bars 142, 143, and the needles 144, 145, the parts illustrated in FIGS. 11–13 will bear the same reference characters as like or similar parts shown in FIGS. 1–10 in order to avoid repetitive description.

The needles 44, 45 of the first embodiment are substantially straight throughout their lengths, with the needles in one row 44 being somewhat longer than the needles 45 in the other row so that the needles may be secured in the overlapping portions or projections **42*b*, 43*b* (FIGS. 9 and 10) and will not interfere with the indexing of the needles 44 with respect to the needles 45. In the modified form of the needle bar arrangement, it will be observed that the needle bars, indicated at 142, 143 in FIGS. 11–13 may be devoid of any projecting portions on the proximal surfaces thereof comparable to those portions 42*b*, 43*b* on the needle bars 42, 43 in FIGS. 2, 3, 9, and 10. This is because of the fact that the needles 144, 145 in FIGS. 11–13 are bent or curved intermediate their ends, as at 80, to provide an offset upper portion or shank 81 on each needle 144, 145 which extends parallel to the body or lower portion 82 of each respective needle 144, 145 and serves for being received and secured in corresponding holes or bores 83 in the needle bars 142, 143, as by suitable set screws 84**.

By referring to FIG. 12 and comparing the same with FIG. 13, it will be observed that the shanks 83 of the needle 144 are offset outwardly or forwardly with respect to the shanks 83 of the needles 145 so that the body portions 82 of the needles of both rows 144, 145 are normally indexingly arranged with each other so that the needles 144, 145 are in alignment widthwise of the fabric during each active stroke of the needle bars in penetrating the base fabric and in the forming of pile tufts thereon. On the other hand, as is the case in the first embodiment of the invention, it is apparent that the body portions 82 of the needles 144 may be moved out of alignment relative to the body portions 82 of the needles 145 so that the needle bars 142, 143 may then be shogged relative to each other for effecting the desired pattern arrangement of the next succeeding transverse row of pile tufts.

Since the construction of the needle bars 142, 143 and the supporting means therefor may otherwise be identical to that heretofore described with respect to FIGS. 110, a further detailed description of the modified form of the invention shown in fIGS. 11, 12, and 13 is deemed unnecessary. It is apparent that needles and needle bars of either form of the invention may be utilized with equal facility for carrying out the method of this invention.

In the drawings and specification there have been set forth preferred embodiments of the invention and, although specific terms are employed, they are used in a generic and descriptive sense only, and not for purposes of limitation, the scope of the invention being defined in the claims.

That which is claimed is:

1. The combination with a tufting machine having means for advancing a base fabric therethrough, of a pair of first and second elongate needle bars having respective first and second rows of needles thereon normally longitudinally aligned to form a single row of needles with the needles of the rows being in alternation to serve as one needle bar during the tufting operation, means for effecting relative lateral movement to the rows of needles for positioning the rows of needles out of alignment with each other, and means for effecting relative longitudinal movement to the rows of needles while they are out of alignment with each other for changing the order of the needles in the single row to be formed when the needles are moved back into alignment.

2. A tufting machine according to claim 1 including means for varying the speed of said base fabric advancing means for varying the density of pile tufts to be formed thereon.

3. The combination with a tufting maching having means for advancing a base fabric therethrough, of a pair of elongate needle bars extending transversely of the machine and each having a row of tufting needles thereon, the needles of one of the rows normally being arranged in alternation with and positioned in alignment with the needles in the other row to form a single row of aligned needles extending transversely of the machine for serving as one needle bar during the tufting operation, and means for shifting at least said one of the rows of needles laterally out of and laterally back into alignment with, and longitudinally relative to, the needles in the other row so as to change the order of the needles in the single row formed thereof between successive tuft-forming strokes of the needles through the base fabric.

4. The combination with a tufting machine having means for advancing a base fabric therethrough, of a pair of first and second elongate needle bars extending transversely of the machine and having respective first and second rows of needles thereon, the needles of said first row normally being arranged in alternation with and positioned in alignment with the needles of said second row to form a single row of aligned needles extending transversely of the machine for serving as one needle bar during the tufting operation, means for shifting at least one of said rows of needles laterally out of and laterally back into alignment with the needles in the other row between successive tufting operations of the machine, and means for shifting said first row of needles longitudinally relative to said second row of needles while said one row of needles is out of alignment with said other row of needles so as to change the order of the needles in the single row to be formed therefrom.

5. A tufting machine according to claim 4 wherein said means for shifting said first row of needles longitudinally includes means for also shifting said second row of needles longitudinally relative to said first row of needles.

6. A tufting machine according to claim 4 wherein said means for shifting said first row of needles longitudinally includes means for also shifting said second row of needles longitudinally simultaneously with and in a direction opposite from that of said first row of needles.

7. A tufting machine according to claim 4 wherein said needle bars and the needles thereof move into and out of the base fabric in reciprocatory active and inactive strokes during successive tuft operations and wherein said means for shifting one of said rows of needles laterally comprises means responsive to each inactive stroke of the needles for momentarily shifting said one row of needles laterally out of alignment with said other row of needles.

8. A tufting machine according to claim 4 wherein said means for shifting said first row of needles longitudinally includes means for shifting both said first row and said second row of needles in opposite longitudinal directions relative to each other and in a stepwise manner so that each row of needles is moved in the same longitudinal direction relative to the other row of needles during at least two successive stepwise movements thereof.

9. A tufting machine according to claim 4 wherein the base fabric is advanced in a substantially horizontal path and the needles in said first and second rows of needles extend substantially vertically and move downwardly into and upwardly out of the base fabric for inserting portions of the respective pile yarns in the base fabric during each tufting operation, characterized in having means for directing the pile yarns to the needles in a downwardly convergent manner so that the pile yarns being directed to the first row of needles extend downwardly and inwardly in converging relation to the pile yarns being directed to the second row of needles to avoid entangling the pile yarns with the needles during the shifting of said first row of needles longitudinally relative to said second row of needles.

10. In a tufting machine having a pair of needle bars each having a row of needles thereon, the rows of needles on the respective needle bars normally being in longitudinal alignment so as to align the rows of needles on the respective bars with each other with the needles in alternation with each other to form a single row of needles therefrom, means cooperating with at least one of said needle bars therefrom, means cooperating with at least one of said needle bars for shifting the needles thereof laterally out of an laterally back into alignment with the needles in the other row, and means for longitudinally shifting at least one of the rows of needles relative to the needles in the other row while they are out of alignment with each other so as to change the order of the needles in the single row to be formed thereon.

11. A method of tufting on a tufting machine having a pair of needle bars each with a row of needles thereon with respective yarns extending through the needles, said method comprising positioning the needle bars relative to each other so as to align the rows of needles on the respective bars with each other, with the needles on one bar being arranged in alternation with the needles on the other bar, moving the thus alined rows of needles into and out of a base fabric to form a row of pile tufts thereon extending across the base fabric, moving the base fabric past the needle bars, changing the relative order of the yarns carried by the respective rows of needles by positioning the rows of needles out of alignment with each other, longitudinally shifting at least one of the out-of-alignment rows of needles relative to the other row of needles, then moving the rows of needles back into alignment with each other, and again inserting the rows of aligned needles through the base fabric to form another row of pile tufts thereon.

12. A method of tufting according to claim 11 which includes longitudinally shifting the other of said out-of-alignment rows of needles simultaneously with, but in the opposite direction from the shifting of said one row of needles longitudinally.

13. A method according to claim 11 which includes adjustably varying the rate of movement of the base fabric past the needle bars to vary the number of rows of pile tufts per unit length of fabric so as to obtain the precise desired pile density of the fabric.

* * * * *

UNITED STATES PATENT AND TRADEMARK OFFICE

CERTIFICATE OF CORRECTION

PATENT NO. : 4,398,479

DATED : August 16, 1983

INVENTOR(S) : Paul A. Czelusniak, Jr.

It is certified that error appears in the above-identified patent and that said Letters Patent is hereby corrected as shown below:

Column 1, line 44, "staton" should be --station--.

Column 3, line 3, "wise" should be --wide--.

Column 7, line 41, "obltain" should be --obtain--.

Claim 11, Column 10, line 62, "alined" should be --aligned--.

Abstract, line 5, "turfting" should be --tufting--.

Signed and Sealed this

*Sixth* Day of *March 1984*

[SEAL]

*Attest:*

GERALD J. MOSSINGHOFF

*Attesting Officer*

*Commissioner of Patents and Trademarks*